US005706905A

United States Patent [19]

Barr

[11] Patent Number: 5,706,905

[45] Date of Patent: Jan. 13, 1998

[54] STEERABLE ROTARY DRILLING SYSTEMS

[75] Inventor: John D. Barr, Cheltenham, England

[73] Assignee: Camco Drilling Group Limited, of Hycalog, Stonehouse, England

[21] Appl. No.: 604,324

[22] Filed: Feb. 21, 1996

[30] Foreign Application Priority Data

Feb. 25, 1995 [GB] United Kingdom ..... 9503830

[51] Int. Cl.[6] ..... E21B 7/06

[52] U.S. Cl. ..... 175/61; 175/73

[58] Field of Search ..... 175/61, 73, 24

[56] References Cited

U.S. PATENT DOCUMENTS

| | | | |
|---|---|---|---|
| 4,637,479 | 1/1987 | Leising | 175/61 X |
| 4,790,394 | 12/1988 | Dickinson, III et al. | 175/61 |
| 4,836,301 | 6/1989 | Van Dongen et al. | 175/61 |
| 4,991,667 | 2/1991 | Wilkes, Jr. et al. | 175/61 |
| 5,513,713 | 5/1996 | Groves | 175/73 |
| 5,553,679 | 9/1996 | Thorp | 175/73 |
| 5,603,385 | 2/1997 | Colebrook | 175/45 |

FOREIGN PATENT DOCUMENTS

| | | |
|---|---|---|
| 2257182 | 1/1993 | United Kingdom . |
| 2259316 | 3/1993 | United Kingdom . |
| 2298217 | 8/1996 | United Kingdom . |

*Primary Examiner*—Hoang C. Dang

[57] ABSTRACT

A modulated bias unit, for use in a steerable rotary drilling system, comprises a number of hydraulic actuators spaced apart around the periphery of the unit, each having a movable thrust member which is hydraulically displaceable outwardly for engagement with the formation of the borehole, and a control valve operable to bring the actuators alternately in succession into and out of communication with a source of fluid under pressure, as the bias unit rotates. The fluid pressure supplied to each actuator may thus be modulated in synchronism with rotation of the drill bit, and in selected phase relation thereto, so that each movable thrust member is displaced outwardly at the same rotational position of the bias unit so as to apply a lateral bias to the unit for the purposes of steering an associated drill bit. To enable the biasing action to be neutralized or reduced there is provided an auxiliary shut-off valve in series with the control valve, which is operable to prevent the control valve from passing the maximum supply of fluid under pressure to the hydraulic actuators.

15 Claims, 5 Drawing Sheets

STEERABLE ROTARY DRILLING SYSTEMS

BACKGROUND OF THE INVENTION

1. Field of the Invention

The invention relates to steerable rotary drilling systems. When drilling or coring holes in subsurface formations, it is sometimes desirable to be able to vary and control the direction of drilling, for example to direct the borehole towards a desired target, or to control the direction horizontally within the payzone once the target has been reached. It may also be desirable to correct for deviations from the desired direction when drilling a straight hole, or to control the direction of the hole to avoid obstacles.

2. Setting on the Invention

Rotary drilling is defined as a system in which a bottom hole assembly, including the drill bit, is connected to a drill string which is rotatably driven from the drilling platform at the surface. Hitherto, fully controllable directional drilling has normally required the drill bit to be rotated by a downhole motor. The drill bit may then, for example, be coupled to the motor by a double tilt unit whereby the central axis of the drill bit is inclined to the axis of the motor. During normal drilling the effect of this inclination is nullified by continual rotation of the drill string, and hence the motor casing, as the bit is rotated by the motor. When variation of the direction of drilling is required, the rotation of the drill sling is stopped with the bit tilted in the required direction. Continued rotation of the drill bit by the motor then causes the bit to drill in that direction.

Although such arrangements can, under favorable conditions, allow accurately controlled directional drilling to be achieved using a downhole motor to drive the drill bit, there are reasons why rotary drilling is to be preferred, particularly in long reach drilling.

Accordingly, some attention has been given to arrangements for achieving a fully steerable rotary drilling system. For example, British Patent Specification No. 2259316 describes various steering arrangements in which there is associated with the rotary drill bit a modulated bias unit. The bias unit comprises a number of hydraulic actuators spaced apart around the periphery of the unit, each having a movable thrust member which is hydraulically displaceable outwardly for engagement with the formation of the borehole being drilled. Each actuator has an inlet passage for connection to a source of drilling fluid under pressure and an outlet passage for communication with the annulus.

A control valve connects the inlet passages in succession to the source of fluid under pressure, as the bias unit rotates. The valve serves to modulate the fluid pressure supplied to each actuator in synchronism with rotation of the drill bit, and in selected phase relation thereto whereby, as the drill bit rotates, each movable thrust member is displaced outwardly at the same selected rotational position so as to bias the drill bit laterally and thus control the direction of drilling.

In operation of a steerable rotary drilling system of this kind, it may be required, when the borehole is being drilled in the required direction, to turn off or reduce the biasing effect of the modulated bias unit so as, for example, to drill a straight section of the borehole. The present invention provides, in one aspect, a modulated bias unit whereby the biasing effect of the unit may be readily turned off or reduced during drilling operations.

SUMMARY OF THE INVENTION

According to the first aspect of the invention, there is provided a modulated bias unit, for use in a steerable rotary drilling system, of the kind including at least one hydraulic actuator, at the periphery of the unit, having a movable thrust member which is hydraulically displaceable outwardly for engagement with the formation of the borehole being drilled, and a control valve operable to bring the actuator alternately into and out of communication with a source of fluid under pressure, as the bias unit rotates so that, in use, the fluid pressure to the actuator may be modulated in synchronism with rotation of the drill bit, and in selected phase relation thereto, whereby the movable thrust member can be displaced outwardly at the same rotational position of the bias unit, the bias unit being characterized by the provision of auxiliary valve means, preferably in series with said control valve, operable between a first position where it permits the control valve to pass a maximum supply of fluid under pressure to the hydraulic actuator, and a second position where it prevents the control valve from passing said maximum supply of fluid under pressure to the hydraulic actuator, The invention is applicable to a bias unit where there is provided only a single hydraulic actuator, but preferably, as previously mentioned, there are provided a plurality of hydraulic actuators spaced apart around the periphery of the unit, said control valve then being operable to bring the actuators successively into and out of communication with said source of fluid under pressure, as the bias unit rotates.

The auxiliary valve means may be located upstream or downstream of the control valve, although upstream is preferred, for practical reasons, in the preferred embodiment to be described.

Preferably the auxiliary valve means is adapted to cut off the supply of fluid to the hydraulic actuator substantially completely when in said second position.

Alternatively, the auxiliary valve means may be adapted, when in its second position, to direct a proportion of the fluid under pressure away from the hydraulic actuator and to a lower pressure zone, such as the annulus between the drill string and the walls of the borehole.

The control valve may include two relatively rotatable parts comprising a first part having an inlet aperture in communication with said source of fluid under pressure and a second part having at least one outlet aperture in communication with said hydraulic actuator, said inlet aperture, in use, being brought successively into and out of communication with said outlet aperture on relative rotation between said valve parts, the aforesaid auxiliary valve means comprising third and fourth parts, the fourth part being movable relative to the third part between said first position where it allows fluid to pass through the control valve to the actuator and said second position where it at least reduces such flow.

Said control valve may be a disc valve wherein said relatively rotatable parts comprise two contiguous coaxial discs, and in this case said auxiliary valve means may comprise coaxial third and fourth discs, each formed with at least one aperture and which exposes an aperture of the other when in said first position relative thereto and at least partly closes said aperture when in said second position relative thereto.

Although any suitable means may be provided to effect operation of the auxiliary valve means, according to preferred embodiments of the invention said third and fourth parts constituting the auxiliary valve means may be moved between their first and second relative positions by the reversal of the direction of relative rotation between said first and second parts of the control valve. The two parts of the auxiliary valve means may be connected by a lost motion connection whereby said lost motion is taken up upon reversal of the direction of relative rotation.

Such arrangement has the important advantage of requiring only a minimum of extra hardware to be added to the basic bias unit system. This system will normally already include means for controlling the relative rotation between the parts of the control valve, so that the reverse operation of the control valve necessary to operate the auxiliary valve means is already available. It is therefore only necessary to couple to the control valve the actual components of the auxiliary valve itself, and no additional control mechanism for controlling operation of the auxiliary valve is required.

Accordingly, this preferred embodiment of the invention may provide simplicity as well as intrinsic reliability.

In a preferred arrangement, a control shaft drives the first part of the control valve through the lost motion connection, one part of the auxiliary valve means being connected to the control shaft, and the other part of the auxiliary valve means being mechanically connected to the first part of the control valve. In this case, the second part of the control valve is connected to the bias unit body.

The mechanical connection between the other part of the auxiliary valve and the first part of the control valve contains a fluid passage from the aperture on the other part of the auxiliary valve to the aperture on the first part of the control valve. These two parts may be bonded together, for example by brazing or glueing, or they could comprise integral portions of a single component.

In another, non-preferred, arrangement the first part of the control valve is connected directly to the control shaft and the second part is connected to the body through a lost motion connection, one part of a multiple auxiliary valve being connected to the second part of the control valve and the other to the bias unit body.

DETAILED DESCRIPTION OF THE PREFERRED EMBODIMENTS

In the following description the terms "clockwise" and "anti-clockwise" refer to the direction of rotation as viewed looking downhole.

Figure 1:
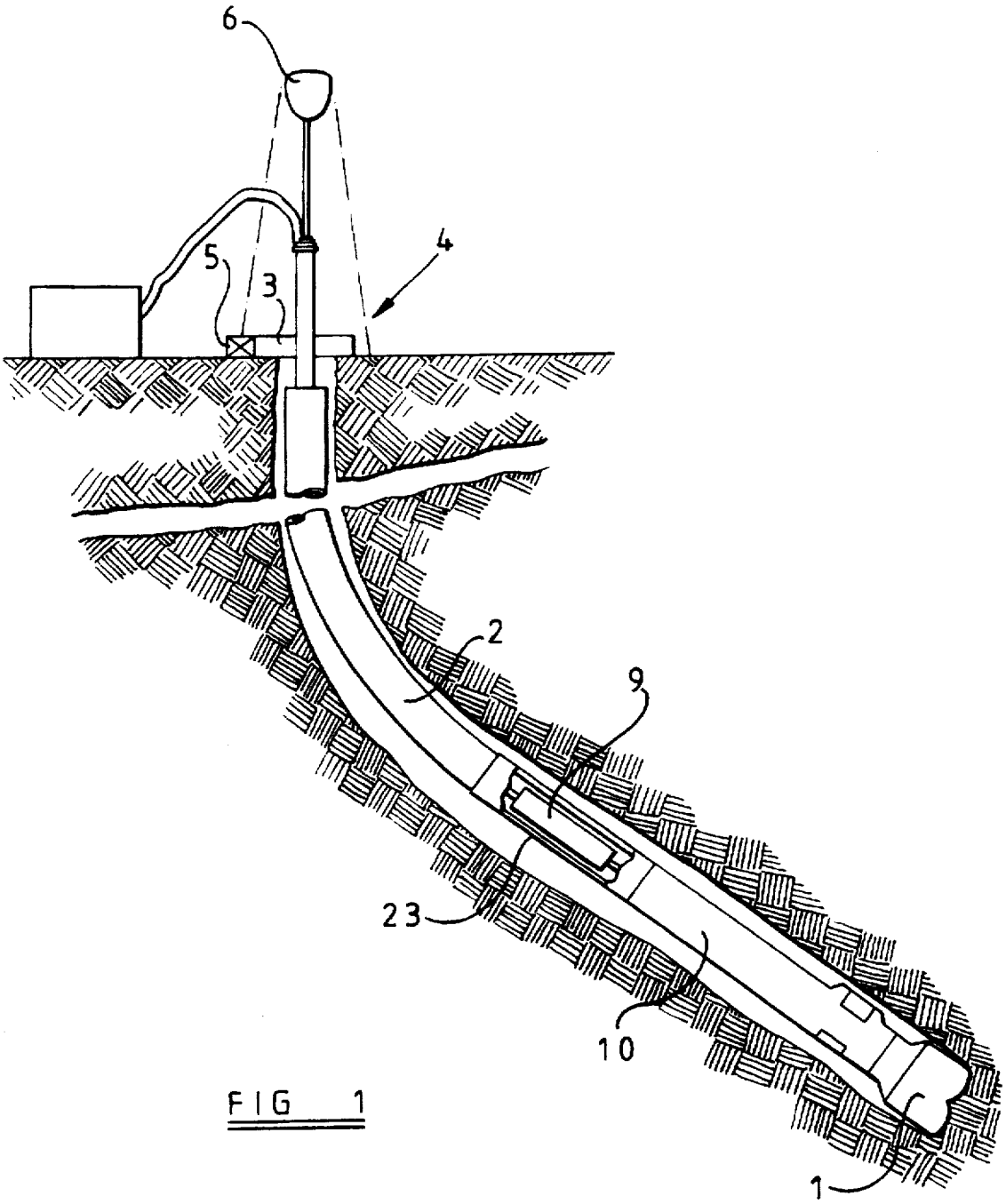
FIG. 1 is a diagrammatic sectional representation of a deep hole drilling installation.

FIG. 1 shows diagrammatically a typical rotary drilling installation of a kind in which the system according to the present invention may be employed.

As is well known, the bottom hole assembly includes a drill bit 1, and is connected to the lower end of a drill string 2 which is rotatably driven from the surface by a rotary table 3 on a drilling platform 4. The rotary table is driven by a drive motor indicated diagrammatically at 5 and raising and lowering of the drill string, and application of weight-on-bit, is under the control of draw works indicated diagrammatically at 6.

The bottom hole assembly includes a modulated bias unit 10 to which the drill bit 1 is connected and a roll stabilized control unit 9 which controls operation of the bias unit 10 in accordance with an onboard computer program, and/or in accordance with signals transmitted to the control unit from the surface. The bias unit 10 may be controlled to apply a lateral bias to the drill bit 1 in a desired direction so as to control the direction of drilling.

Figure 2:
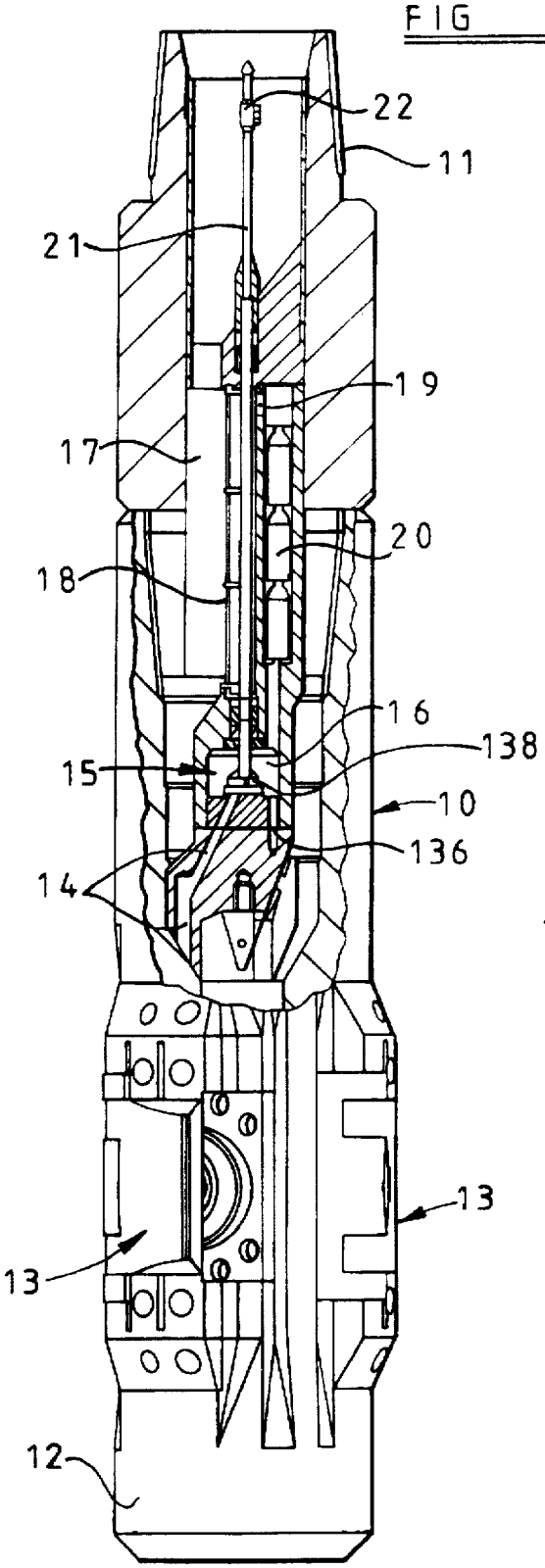
FIG. 2 is a part-longitudinal section, part side elevation of a prior art modulated bias unit of the kind to which the present invention may be applied.

Referring to FIG. 2, the bias unit 10 comprises an elongate main body structure provided at its upper end with a threaded pin 11 for connecting the unit to a drill collar, incorporating the roll stabilized control unit 9, which is in turn connected to the lower end of the drill string. The lower end 12 of the body structure is formed with a socket to receive the threaded pin of the drill bit. The drill bit may be of any type.

There are provided around the periphery of the bias unit, towards its lower end, three equally spaced hydraulic actuators 13. Each hydraulic actuator 13 is supplied with drilling fluid under pressure through a respective passage 14 under the control of a rotatable disc valve 15 located in a cavity 16 in the body structure of the bias unit. Drilling fluid delivered under pressure downwardly through the interior of the drill siring, in the normal manner, passes into a central passage 17 in the upper part of the bias unit, through a filter 18 consisting of closely spaced longitudinal wires, and through an inlet 19 into the upper end of a vertical multiple choke unit 20 through which the drilling fluid is delivered downwardly at an appropriate pressure to the cavity 16.

The disc valve 15 is controlled by an axial shaft 21 which is connected by a coupling 22 to the output shaft of the roll stabilized control unit 9.

The roll stabilized control unit maintains the shaft 21 substantially stationary at a rotational orientation which is selected, either from the surface or by a downhole computer program, according to the direction in which the drill bit is to be steered. As the bias unit rotates around the stationary shaft 21 the disc valve 15 operates to deliver drilling fluid under pressure to the three hydraulic actuators 13 in succession. The hydraulic actuators are thus operated in succession as the bias unit rotates, each in the same rotational position so as to displace the bias unit laterally in a selected direction. The selected rotational position of the shaft 21 in space thus determines the direction in which the bias unit is actually displaced and hence the direction in which the drill bit is steered.

Figure 3:
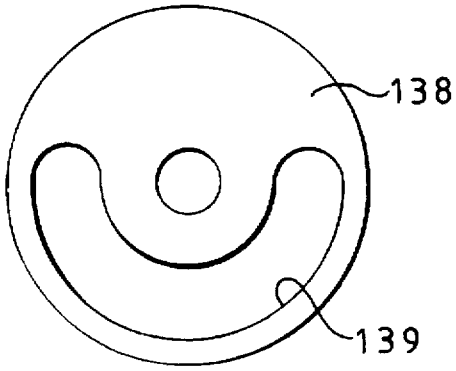
FIGS. 3 and 4 are plan views of the two major components of the disc vane employed in the prior art bias unit.
Figure 4:
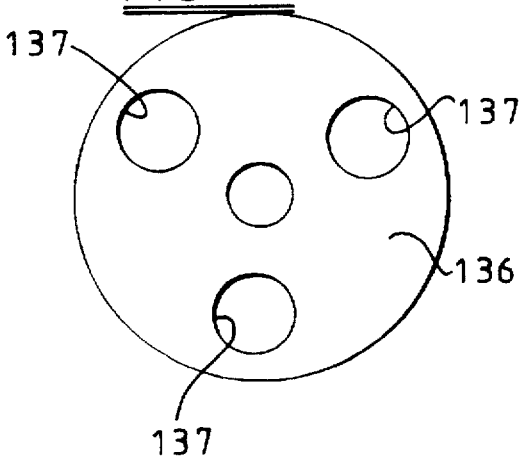

FIGS. 3 and 4 show in greater detail the construction of the components of the prior art disc valve 15. The disc valve comprises a lower disc 136 which is fixedly mounted, for example by brazing or glueing, on a fixed part of the body structure of the bias unit. The lower disc 136 comprises an upper layer of polycrystalline diamond bonded to a thicker substrate of cemented tungsten carbide. As best seen in FIG. 4 the disc 136 is formed with three equally circumferentially spaced circular apertures 137 each of which registers with a respective passage 14 in the body structure of the bias unit.

The upper disc 138 is brazed or glued to a shaped element on the lower end of the shaft 21 and comprises a lower facing layer of polycrystalline diamond bonded to a thicker substrate of tungsten carbide. As best seen in FIG. 3, the disc 138 is formed with an arcuate aperture 139 extending through approximately 180. The arrangement is such that as the lower disc 136 rotates beneath the upper disc 138 (which is held stationary, with the shaft 21, by the aforementioned roll stabilized control unit 9) the apertures 137 are successively brought into communication with the aperture 139 in the upper disc so that drilling fluid under pressure is fed from the cavity 16, through the passages 14, and to the hydraulic actuators in succession. It will be seen that, due to the angular extent of the aperture 139, a following aperture 137 begins to open before the previous aperture has closed.

In order to locate the discs 136 and 138 of the disc valve radially, an axial pin of polycrystalline diamond may be received in registering sockets in the two discs.

Figure 5:
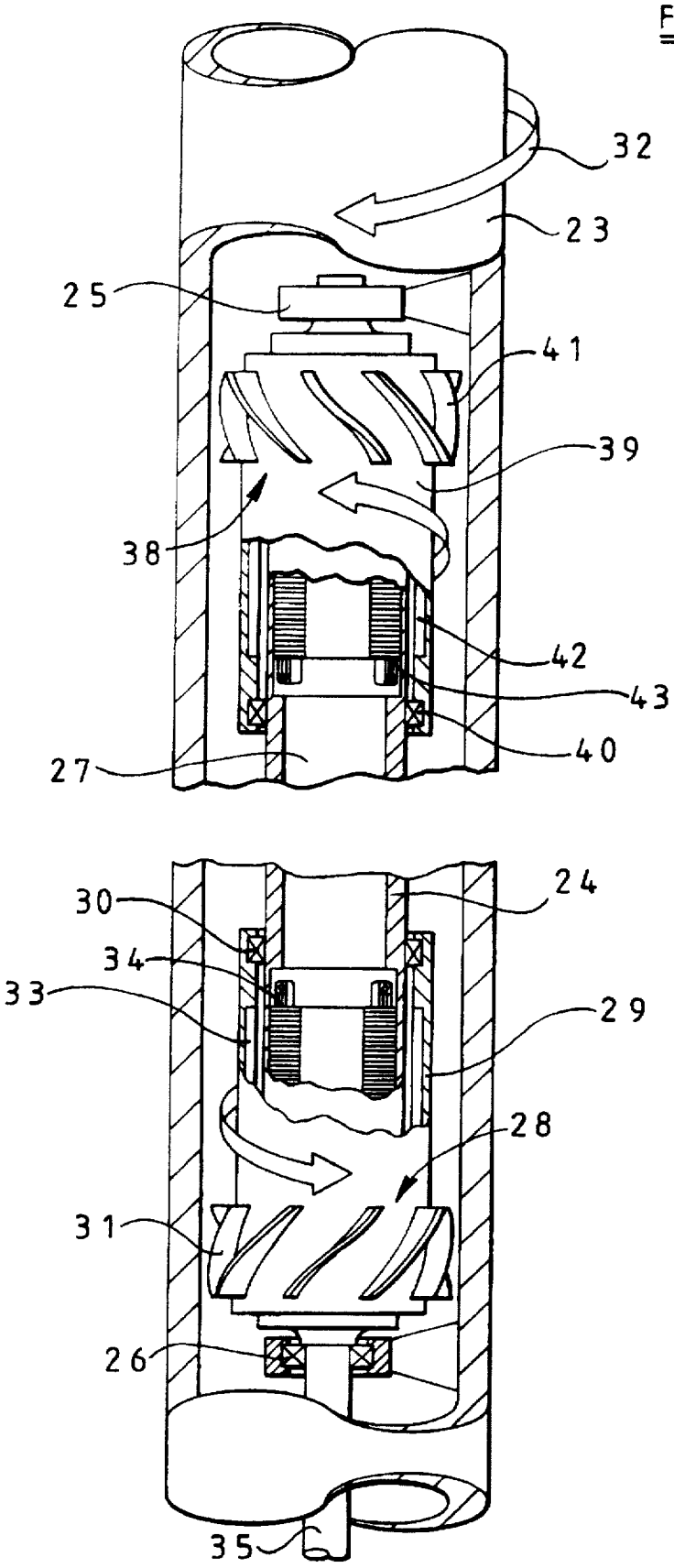
FIG. 5 is a diagrammatic longitudinal section through a roll stabilized instrumentation package, acting as a control unit for the bias unit of FIGS. 2–4.

FIG. 5 shows diagrammatically, in greater detail, one form of roll stabilized control unit for controlling a bias unit of the kind shown in FIG. 2. Other forms of roll stabilized control unit are described in British Patent Specification No. 2257182, and in co-pending Application No. 9503828.7

Referring to FIG. 5, the support for the control unit comprises a tubular drill collar 23 forming part of the drill string. The control unit comprises an elongate generally cylindrical hollow instrument carrier 24 mounted in bearings 25, 26 supported within the drill collar 23, for rotation relative to the drill collar 23 about the central longitudinal axis thereof. The carrier has one or more internal compartments which contain an instrument package 27 comprising sensors for sensing the rotation and orientation of the control unit, and associated equipment for processing signals from the sensors and controlling the rotation of the carrier.

At the lower end of the control unit a multi-bladed impeller 28 is rotatably mounted on the carrier 24. The impeller comprises a cylindrical sleeve 29 which encircles the carrier and is mounted in bearings 30 thereon. The blades 31 of the impeller are rigidly mounted on the lower end of the sleeve 29. During drilling operations the drill string, including the drill collar 23, will normally rotate clockwise, as indicated by the arrow 32, and the impeller 28 is so designed that it tends to be rotated anti-clockwise as a result of the flow of drilling fluid down the interior of the collar 23 and across the impeller blades 31.

The impeller 28 is coupled to the instrument carrier 24, by an electrical torquer-generator. The sleeve 29 contains around its inner periphery a pole structure comprising an array of permanent magnets 33 cooperating with an armature 34 fixed within the carrier 24. The magnet/armature arrangement serves as a variable drive coupling between the impeller 28 and the carrier 24.

A second impeller 38 is mounted adjacent the upper end of the carrier 24. The second impeller is, like the first impeller 28, also coupled to the carrier 24 in such a manner that the torque it imparts to the carrier can be varied. The upper impeller 38 is generally similar in construction to the lower impeller 28 and comprises a cylindrical sleeve 39 which encircles the carrier casing and is mounted in bearings 40 thereon. The blades 41 of the impeller are rigidly mounted on the upper end of the sleeve 39. However, the blades of the upper impeller are so designed that the impeller tends to be rotated clockwise as a result of the flow of drilling fluid down the interior of the collar 23 and across the impeller blades 41.

Like the impeller 28, the impeller 38 is coupled the carrier 24 by an electrical torquer-generator. The sleeve 39 contains around its inner periphery an array of permanent magnets 42 cooperating with an armature 43 fixed within the carrier 24. The magnet/armature arrangement serves as a variable drive coupling between the impeller 38 and the carrier.

As the drill collar 23 rotates during drilling, the main bearings 25, 26 and the disc valve 15 of the bias unit apply a clockwise input torque to the carrier 24 and a further clockwise torque is applied by the upper impeller 38 through the torquer-generator 42,43 and its bearings 40. These clockwise torques are opposed by an anti-clockwise torque applied to the carrier by the lower impeller 28. The torque applied to the carrier 24 by each impeller may be varied by varying the electrical load on each generator constituted by the magnets 33 or 42 and the armature 34 or 43. This variable load is applied by a generator load control unit under the control of a microprocessor in the instrument package 27. During steered drilling there are fed to the processor an input signal indicative of the required rotational orientation (roll angle) of the carrier 24, and feedback signals from roll sensors included in the instrument package 27. The input signal may be transmitted to the control unit from the surface, or may be derived from a downhole program defining the desired path of the borehole being drilled in comparison with survey data derived downhole.

The processor is preprogrammed to process the feedback signal which is indicative of the rotational orientation of the carrier 24 in space, and the input signal which is indicative of the desired rotational orientation of the carrier, and to feed a resultant output signal to generator load control units. During steered drilling, the output signal is such as to cause the generator load control units to apply to the torquer-generators 33, 34 and 42,43 electrical loads of such magnitude that the net anticlockwise torque applied to the carrier 24 by the two torquer-generators opposes and balances the other clockwise torques applied to the carrier, such as the bearing torque, so as to maintain the carrier non-rotating in space, and at the rotational orientation demanded by the input signal.

The output from the control unit 9 is provided by the rotational orientation of the carrier itself and the carrier is thus mechanically connected by a single control shaft 35 to the input shaft 21 of the bias unit 10 shown in FIG. 2.

During normal steering operation of the control unit and bias unit, the clockwise torque applied by the second, upper impeller 38 may be maintained constant so that control of the rotational speed of the control unit relative to the drill collar, and its rotational position in space, are determined solely by control of the main, lower impeller 28, the constant clockwise torque of the upper impeller being selected so that the main impeller operates substantially in the useful, linear part of its range.

However, since the clockwise torque may also be varied by varying the electrical load on the upper torquer-generator 42, 43 control means in the instrument package may control the two torquer-generators in such manner as to cause any required net torque, within a permitted range, to be applied to the carrier by the impellers. This net torque will be the difference between the clockwise torque applied by the upper impeller 38, bearings etc. and the anticlockwise torque applied by the lower impeller 28. The control of net torque provided by the two impellers may therefore be employed to roll stabilize the control unit during steering operation, but it may also be employed to cause the control unit to perform rotations or part-rotations in space, or relative to the drill collar 23, either clockwise or anti-clockwise or in a sequence of both, and at any speed within a permitted range. For rotation relative to the drill collar the torquers are controlled by a sensor providing signals dependent on the angle between the instrument carrier 24 and the drill collar 23, and/or its rate of change.

According to the present invention, the control valve 15 of the bias unit shown in FIGS. 2–4 is modified to permit turning off or reduction of the biasing effect of the unit during drilling. One form of modified control valve according to the invention is shown in greater detail in FIGS. 6–8.

Figure 6:
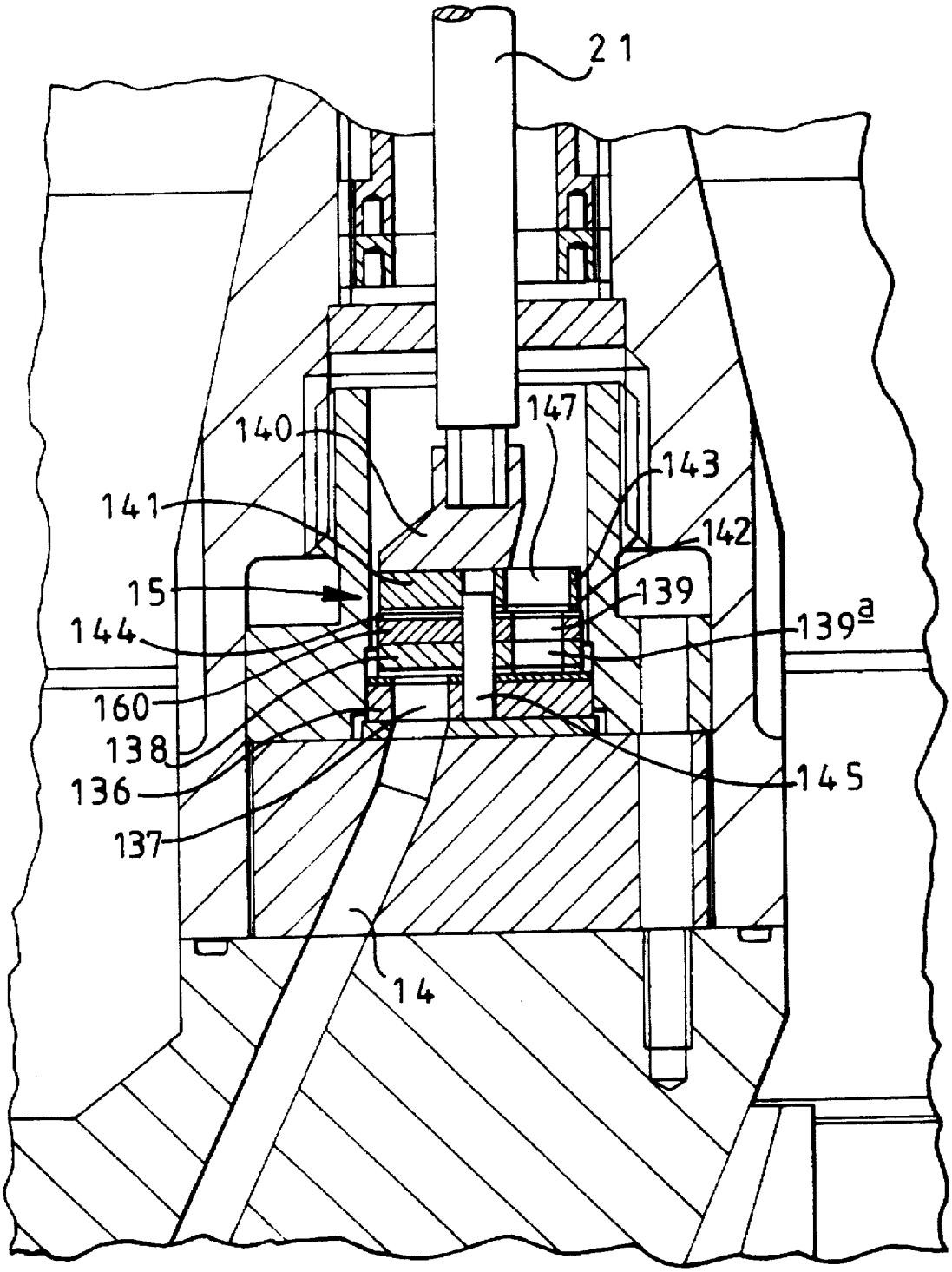
FIG. 6 is a longitudinal section, on an enlarged scale, of a modified form of disc valve, in accordance with the invention, employed in the bias unit.

Referring to FIG. 6, as in the prior art arrangement previously described the lower disc 136 of the disc valve 15 is brazed or glued on a fixed part of the body structure of the bias unit and the disc 136 is formed with three equally circumferentially spaced circular apertures 137 each of which registers with a respective passage 14 in the body structure.

However, in the arrangement according to the invention the upper disc 138 is not directly brazed or glued to the element 140 on the lower end of the shaft 21 but is instead brazed to the tungsten carbide face of a similar third disc 160 which is connected by a lost motion connection to a fourth, further disc 141 which is brazed or glued to the element 140 on the shaft 21. The fourth disc 141 comprises a lower facing layer 142 of polycrystalline diamond bonded to a thicker substrate 143 of tungsten carbide. The third disc 160 is provided with an upper facing layer 144 of polycrystalline diamond, which bears against the layer 142, on the further disc 141. The disc 138 has a previously described lower facing layer of polycrystalline diamond which bears against a similar upper facing layer on the lower disc 136. The four discs 136, 138, 141 and 160 are located on an axial pin 145, which may be of polycrystalline diamond, and is received in registering central sockets in the discs.

Figure 7:
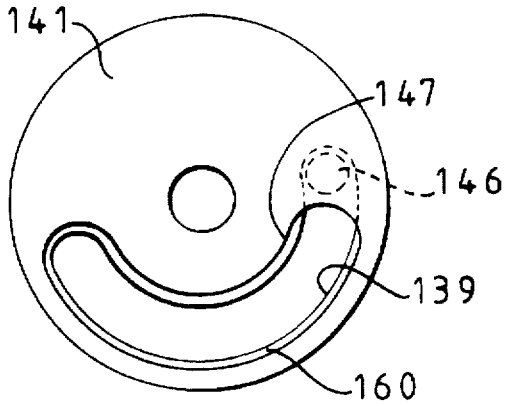
FIGS. 7 and 8 are diagrammatic plan views of two of the elements of the disc valve of FIG. 6, showing first and second positions thereof respectively and, FIGS. 9 and 10 are similar views to FIGS. 7 and 8, showing an alternative construction for the disc valve.

The lost motion connection between the disc 160 and the fourth, further disc 141 comprises a downwardly projecting circular pin 146 (see FIG. 7) which projects from the lower surface of the disc 141 into registering arcuate slots 139, **139*a* in the valve discs 160 and 138. As best seen in FIG. 7 the upper disc 141 is formed with an arcuate slot 147 which is of similar width and radius to the slot 139 but of smaller angular extent. The discs 141 and 160** constitute auxiliary valve means according to the present invention.

During steered drilling operations the drill bit and bias unit 10 rotate clockwise, as seen from above, and the control shaft 21 is maintained substantially stationary in space at a rotational orientation determined by the required direction of bias, as previously described. Consequently the bias unit and lower disc 136 of the control valve rotate clockwise relative to the shaft 21, the disc 138 of the control valve, and the upper discs 160 and 141. The frictional engagement between the lower disc 136 and disc 138 of the control valve rotates the discs 138 and 160 clockwise relative to the stationary upper disc 141 so that the right hand end of the slot 139 (as seen in FIG. 7) engages the pin 146 on the disc 141. In this position the arcuate slot 147 in the uppermost disc 141 registers with the major part of the arcuate slot 160 in the disc 138 so that drilling fluid under pressure passes through the registering slots and then through the spaced apertures 137 in the lower disc 136 in succession as the disc 136 is rotated beneath the disc 138. This is the position of the valve components during drilling when a lateral bias is required.

If it is required to shut off the bias, the control unit 9 is instructed, either by preprogramming of its downhole processor or by a signal from the surface, to reverse its direction of rotation relative to the drill string, i.e., to rotate clockwise in space at a rotational speed faster than the rate of clockwise rotation of the drill bit and bias unit for at least half a revolution. This causes the shaft 21 and hence the disc 141 to rotate clockwise relative to the bias unit and to the lowermost disc 136. This reversal may be continuous or of short duration.

Figure 8:
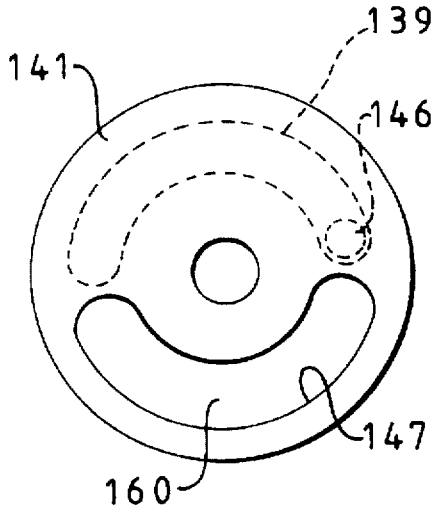

Under these conditions, the frictional torque of the disc 138 on the lowermost disc 136 exceeds that between the fourth disc 141 and the third disc 160. The fourth disc 141 rotates clockwise relative to the third disc 160 until the lost motion between the two discs is taken up so that the pin 146 is moved to the opposite end of the slot 139, as shown in FIG. 8. This brings the slot 139 out of register with the slot 147 in the uppermost disc 141, so that the slots 139 and **139*a*, and hence the apertures 137**, are cut off from communication with the drilling fluid under pressure. As a consequence the hydraulic actuators of the bias unit are no longer operated in succession and the force exerted on the formation by the movable thrust members of the actuators falls to zero or is substantially reduced.

In order to provide the required frictional torque differential between the discs to achieve the above manner of operation, the discs 136 and 138 may be larger in radius than the discs 160 and 141. Alternatively or additionally, the slot 147 is preferably wider than the slot 139 to provide a greater downward axial hydraulic force on the disc 160, and thus give greater total force between the discs 138 and 136 than between the discs 141 and 160 when the auxiliary valve is open. Also, part of the upper surface of the disc 160 may be rebated from one edge to increase the axial hydraulic force on the disc 160 when the auxiliary valve is closed.

In the described arrangement the additional third disc 141 and fourth disc 160 serve as an auxiliary valve means which cuts off the supply of drilling fluid under pressure to the control valve constituted by the discs 138 and 136. It will be appreciated that such auxiliary valve means need not be immediately adjacent the control valve, but could be in any other location, spaced upstream from the control valve and arranged, when operated, to shut off the supply of drilling fluid to the control valve.

Figure 9:
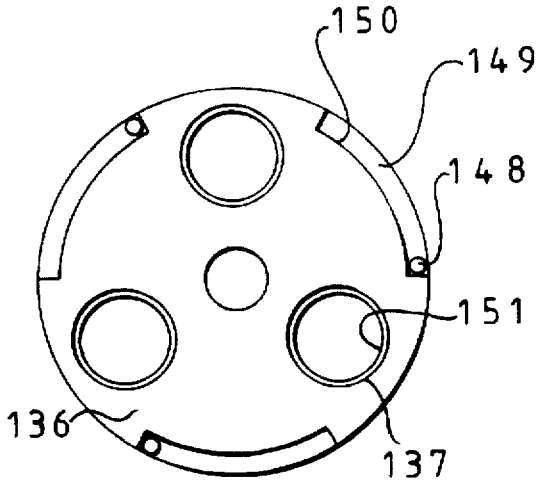
Figure 10:
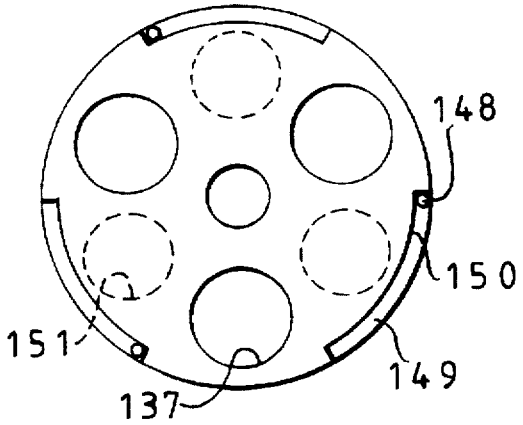

Instead of the auxiliary valve means being disposed upstream of the control valve, as shown in FIGS. 6–8, it may be disposed downstream of the control valve. In this case the auxiliary valve means effectively comprises three valves, each interposed between one outlet of the control valve and the respective hydraulic actuator. FIGS. 9 and 10 illustrate such an arrangement diagrammatically. The upper disc 138 of the control valve is brazed or glued directly to the element 140 on the lower end of the shaft 21, as in the prior art arrangement, and the disc 136 of the control valve is brazed to a similar third disc which is connected to a lower coaxial fourth disc by a lost motion connection, the fourth disc being brazed or glued to the fixed part of the bias unit structure. In this case the lost motion is provided by three equally spaced upwardly projecting pins 148 on the fourth disc 149 being engaged by spaced peripheral recesses 150 around the outer edge of the lower disc 136 of the control valve, and the third disc which is brazed beneath it.

During operation of the bias unit, when a lateral bias is required, the bias unit, together with the fourth disc 149, rotates clockwise relative to the roll stabilized shaft 21 and the frictional engagement of the stationary upper disc 138 on the disc 136 displaces it anti-clockwise relative to the lower disc 149 to the first position shown in FIG. 9 where the apertures 137 in the disc 136 are in register with corresponding apertures 151 in the additional disc 149.

When it is required to render the bias unit ineffective in providing a lateral bias to the drill bit, the control unit 9 is, as before, instructed to rotate the shaft 21 and hence the disc 138 clockwise relative to the bias unit so that the frictional engagement of the upper disc 138 of the control valve on the lower disc 136 rotates the disc 136 relative to the additional disc 149 to the position shown in FIG. 10, taking up the lost motion between the pins 148 and the recesses 150. In this position the apertures 137 in the disc 136 are now out of register with the apertures 151 in the additional disc 149 so that, again, the passages 14, and hence the hydraulic actuators, are cut off from communication with the drilling fluid and the actuators adopt a withdrawn position where they have no biasing effect on the bias unit or drill bit.

As in the previously described arrangement the discs are designed to provide the required frictional torque differentials to result in the above-described manner of operation.

Again, the auxiliary valve means constituted, in this case, by the fourth disc 149 and the third disc brazed to the disc 136 need not necessarily be located immediately adjacent the control valve, but could be in any other location spaced downstream from the control valve and arranged, when operated, to shut off the flow of drilling fluid through the passages 14. In this case, however, three separate flow passages will be required to connect the control valve to the auxiliary valve.

The auxiliary shut-off valve may also be used to achieve a reduced net biasing effect of the bias unit. In this mode of operation the control unit is subjected, over a period, to a succession of temporary reversals of its direction of rotation relative to the drill collar, under the control of the downhole processor or signals from the surface. This has the effect of mining the biasing effect alternately off and on. The net effect of this is to reduce the overall deviation of the borehole, when compared with the deviation which would have occurred had the bias unit been operating continuously. This mode of operation therefore reduces the mean bias provided by the bias unit. The extent of the reduction may be controlled by controlling the relative durations of the off and on periods.

Whereas the present invention has been described in particular relation to the drawings attached hereto, it should be understood that other and further modifications, apart from those shown or suggested herein, may be made within the scope and spirit of the present invention.

What is claimed:

1. A modulated bias unit, for use in a steerable rotary drilling system, of the kind including at least one hydraulic actuator, at the periphery of the unit, having a movable thrust member which is hydraulically displaceable outwardly for engagement with a wall of a borehole being drilled, and a control valve operable to bring the actuator alternately into and out of communication with a source of fluid under pressure, as the bias unit rotates so that, in use, the fluid pressure to the actuator may be modulated in synchronism with rotation of the bias unit, and in selected phase relation thereto, whereby the movable thrust member can be displaced outwardly at the same rotational position of the bias unit, the bias unit being characterized by the provision of auxiliary valve means, operable between a first position where it permits the control valve to pass a maximum supply of fluid under pressure to the hydraulic actuator, and a second position where it prevents the control valve from passing said maximum supply of fluid under pressure to the hydraulic actuator.

2. A bias unit according to claim 1, wherein the auxiliary valve means is in series with said control valve.

3. A bias unit according to claim 1, wherein there are provided a plurality of hydraulic actuators spaced apart around the periphery of the unit, said control valve then being operable to bring the actuators successively into and out of communication with said source of fluid under pressure, as the bias unit rotates.

4. A bias unit according to claim 1, wherein the auxiliary valve means is located upstream of the control valve.

5. A bias unit according to claim 1, wherein the auxiliary valve means is adapted to cut off the supply of fluid to the hydraulic actuator substantially completely when in said second position.

6. A bias unit according to claim 1, wherein the control valve includes two relatively rotatable parts comprising a first part having an inlet aperture in communication with said source of fluid under pressure and a second part having at least one outlet aperture in communication with said hydraulic actuator, said inlet aperture, in use, being brought successively into and out of communication with said outlet aperture on relative rotation between said valve parts, the aforesaid auxiliary valve means comprising third and fourth parts, the fourth part being movable relative to the third part between said first position where it allows fluid to pass through the control valve to the actuator and said second position where it at least reduces such flow.

7. A bias unit according to claim 6, wherein said control valve is a disc valve wherein said relatively rotatable parts comprise two contiguous coaxial discs, and said auxiliary valve means comprise coaxial third and fourth discs, each formed with at least one aperture and which exposes an aperture of the other when in said first position relative thereto and at least partly closes said aperture when in said second position relative thereto.

8. A bias unit according to claim 6, wherein said third and fourth parts constituting the auxiliary valve means are moved between their first and second relative positions by reversal of the direction of relative rotation between said first and second parts of the control valve.

9. A bias unit according to claim 8, wherein the two parts of the auxiliary valve means are connected by a lost motion connection whereby said lost motion is taken up upon reversal of the direction of relative rotation.

10. A bias unit according to claim 9, wherein a control shaft drives the first part of the control valve through the lost motion connection, one part of the auxiliary valve means being connected to the control shaft, and the other part of the auxiliary valve means being mechanically connected to the first part of the control valve, the second part of the control valve being connected to the bias unit body.

11. A bias unit according to claim 10, wherein the mechanical connection between the other part of the auxiliary valve and the first part of the control valve contains a fluid passage from the aperture on the other part of the auxiliary valve to the aperture on the first part of the control valve.

12. A bias unit according to claim 11, wherein the other part of the auxiliary valve and the first part of the control valve are bonded together.

13. A bias unit according to claim 11, wherein the other part of the auxiliary valve and the first part of the control valve comprise integral portions of a single component.

14. A bias unit according to claim 9, wherein the first part of the control valve is connected directly to the control shaft and the second part is connected to the body through said lost motion connection, one part of the auxiliary valve being connected to the second part of the control valve and the other part of the auxiliary valve being connected to the bias unit body.

15. A method of operating a modulated bias unit which includes at least one hydraulic actuator, at the periphery of the unit, having a movable thrust member which is hydraulically displaceable outwardly for engagement with a wall of a borehole being drilled, and a control valve operable to bring the actuator alternately into and out of communication with a source of fluid under pressure, as the bias unit rotates so that, in use, the fluid pressure to the actuator may be modulated in synchronism with rotation of the bias unit, and in selected phase relation thereto, whereby the movable thrust member can be displaced outwardly at the same rotational position of the bias unit, the bias unit including auxiliary valve means, operable between a first position where it permits the control valve to pass a maximum supply of fluid under pressure to the hydraulic actuator, and a second position where it prevents the control valve from passing said maximum supply of fluid under pressure to the hydraulic actuator, the method comprising subjecting the auxiliary valve means, over a period of time during operation of the bias unit, to a succession of temporary operations from its first position to its second position.

* * * * *